US008770257B2

(12) United States Patent
Kao

(10) Patent No.: US 8,770,257 B2
(45) Date of Patent: Jul. 8, 2014

(54) SLAT ROTATION, SLAT WINDING AND UNWINDING CONTROL DEVICE OF WINDOW BLIND

(75) Inventor: Yu-Ting Kao, Tainan (TW)

(73) Assignee: Uni-Soleil Ent. Co., Ltd., Tainan (TW)

( * ) Notice: Subject to any disclaimer, the term of this patent is extended or adjusted under 35 U.S.C. 154(b) by 64 days.

(21) Appl. No.: 13/530,176

(22) Filed: Jun. 22, 2012

(65) Prior Publication Data

US 2013/0340952 A1 Dec. 26, 2013

(51) Int. Cl.
*E06B 9/305* (2006.01)

(52) U.S. Cl.
USPC ..... 160/177 R; 160/174 R

(58) Field of Classification Search
USPC .... 160/168.1 R, 170, 173 R, 174 R, 178.1 R, 160/177 R, 176.1 R, 171, 107
See application file for complete search history.

(56) References Cited

U.S. PATENT DOCUMENTS 3,447,585 A * 6/1969 Abate et al. ..... 160/178.1 R
4,457,351 A * 7/1984 Anderson ..... 160/178.1 R
4,522,244 A * 6/1985 Brolin ..... 160/170
5,908,062 A * 6/1999 Fun ..... 160/170
5,996,667 A * 12/1999 Fun ..... 160/84.01
6,279,642 B1 * 8/2001 Liu ..... 160/177 R
6,601,636 B1 * 8/2003 Liu ..... 160/177 R
7,311,133 B2 * 12/2007 Anderson et al. ..... 160/170
7,389,956 B2 * 6/2008 Hung ..... 242/397
7,549,615 B2 * 6/2009 Shevick ..... 248/254
7,866,367 B2 * 1/2011 Liang et al. ..... 160/173 R
7,886,803 B2 * 2/2011 Anderson et al. ..... 160/170
7,913,738 B2 * 3/2011 Fraser et al. ..... 160/115
8,267,145 B2 * 9/2012 Fraser et al. ..... 160/115
8,485,242 B2 * 7/2013 Fraser et al. ..... 160/115
8,522,852 B2 * 9/2013 Yu et al. ..... 160/84.05
2012/0227913 A1 * 9/2012 Chou ..... 160/176.1 R
2012/0266413 A1 * 10/2012 Kao ..... 16/96 D

* cited by examiner

*Primary Examiner* — Katherine Mitchell
*Assistant Examiner* — Johnnie A Shablack
(74) *Attorney, Agent, or Firm* — Rosenberg, Klein & Lee

(57) ABSTRACT

A slat winding and unwinding control device of window blind includes flexible snap fit portions that are provided on the base to engage directly into the upper beam so that the mounting of the base into the interior of the upper beam is easy. A cord spool is designed to be capable of continuing its rotation in a fitting member so that there is no limitation on the winding direction of the pull cord. Moreover, the fixing of either a connecting strap or a connecting string for connecting each slat of the window blind on a housing member is very easy. Therefore, easiness and handiness in operation can be improved in the overall implementation of the system.

3 Claims, 9 Drawing Sheets

SLAT ROTATION, SLAT WINDING AND UNWINDING CONTROL DEVICE OF WINDOW BLIND

BACKGROUND OF INVENTION

1. Field of the Invention

The present invention relates to a slat rotation, slat winding and unwinding control device of window blind, more particularly to a slat rotation, slat winding and unwinding control device of window blind in which the base can be easily assembled, no limitation is placed upon the winding direction of the pull cord on the cord spool, and either a connecting strap or a connecting string is easily to be fixed on a housing member.

2. Brief Description of the Prior Art

Ordinarily, conventional control device for controlling the opening-closing of slats and lifting or lowering of a window blind are shown in FIG. 8, a perspective exploded view of the structure of the control device; and in FIG. 9, a sectional view of the assembly of the structure of the control device. The control device (7) is mainly formed by a base (71), a fitting member (72), a cord spool (73), a housing member (74), and a rotation member (75). The fitting member (72) is fixed at one end of the base (71), and a pivot hole (711) is formed at the other end of the base (71). A threaded section (721) is formed inside the fitting member (72), which is in threading engagement with the cord spool (73). The cord spool (73) has threading grooves (731) formed on its outer edge, the threading grooves (731) being in threading engagement with the threaded section (721) of the fitting member (72). An aperture (732) is further provided at the outer edge of the cord spool (73) for fixing one end of a pulling cord (733) so that the pulling cord (733) can be wound around the outer edge of the cord spool (73). A flange stopper (734) is formed at the end of the cord spool (73) for preventing the cord spool (73) from swinging out beyond the fitting member (72) to fall off. The housing member (74) is fitted on the base (71) to form correspondingly an accommodation for the fitting member (72) and the cord spool (73). A cavity section (741) is formed at the bottom end face of the housing member (74) so as to house the fitting member (72) and the cord spool (73) therein. A pivot shaft (742) corresponding to the pivot hole (711) of the base (71) is provided at one side of the housing member (74). Further, a locating recess (743) is provided at the top end of the housing member (74), and two locating holes (744) are provided in the locating recess (743). A connecting strap (76) for connecting each slat of the window blind is wound around a locating bar (761) first, and then the strap with the locating bar is placed within the locating recess (743), finally fixing screws (745) are threaded into the locating holes (744) so as to fix the connecting strap (76) with the locating bar (761) in place. One end of the rotation member (75) is to fit with the pivot shaft (742) of the housing member (74). A torsion spring (751) is fitted over the outside of the rotation member (75) which is pivotally disposed within the pivot hole (711) of the base (71). An aperture (752) for fitting with a bracket rod is provided at the outer end face of the rotation member (75) in such a manner that the control device (7) after assembly can be fitted inside from the lateral side of the Upper beam (8) of the window blind for further combination, and the aperture (752) provided at the outer end face of the rotation member (75) is fitted with the bracket rod (81) of the upper beam (8). In this manner, when the rotation member (75) rotates the housing member (74) so as to move the connecting strap (76) (ladder string), so that all slats (77) in unison can rotate an angle to open or to close and the pulling cord (733) wound on the cord spool (73) can be wound or unwound to control the lifting or lowering of the window blind.

Although the above control device can control the opening or closing of each slat and the lifting or lowering of the window blind, however, some drawbacks has been found in practical implementation.

1. The base of the control device can only be fitted inside from the lateral side of the upper beam of the window blind for further combination. If the width of the window blind is wider, i.e., the support rod is longer, it is difficult to fit the control device into the upper beam.

2. A flange stopper is formed at the end of the cord spool for preventing the cord spool from swinging out beyond the fitting member to fall off. So, when the cord spool is rotated to the end in one direction, a big impact force will be produced if force continues to be applied. In this case, the cord spool is blocked by the flange stopper and is unable to continue the rotation, so the cord spool only can rotate back in reverse direction. This may result in limitation on its usage and thus may cause inconvenience.

3. The connecting string for connecting each slat of the window blind has to be wound around the locating bar and then placed in the locating recess at the top end of the housing member and finally is fixed in the locating hole of the locating recess so that the connecting string with the locating bar is fixed in place. It seems the process is troublesome and inconvenient.

SUMMARY OF INVENTION

In the slat rotation, slat winding and unwinding control device of window blind of the present invention, the base has flexible snap fit portions provided at the outside of its both ends, so that the base can be fixed directly into the interior of the upper beam from the upper side thereof by the engagement of the flexible snap fit portions. Therefore, the mounting of the base into the upper beam is easy and convenient. Further, the cord spool is accommodated between the cavity portion of the fitting member and the upper cover, so that the cord spool can continue its rotation within the fitting member, hence there is no limitation on the winding direction of the pull cord. The fitting member together with the cord spool is fitted in the hollow portion of the housing member. The shaft portion at one end of the housing member is pivotally fitted in the pivot hole of the base, and the shaft portion at the other end is fitted in the axial bore of the rotation member. After fitted with the torsion spring over the outside, the other end of the rotation member is pivotally fitted in the pivot hole of the base so that a connecting strap for connecting each slat of the window blind is fixed in the locating recess by the direct fastening of two screw elements through the lid; or a connecting string for connecting each slat of the window blind is placed in the clipping grooves provided at both sides of the locating recess and then the connecting string is similarly fixed in the locating recess by the direct fastening of two screw elements through the lid. Therefore, either the connecting strap or the connecting string is easily to be fixed on the housing member. In this manner, easiness and handiness in operation can be further enhanced in its overall implementation.

DETAILED DESCRIPTION OF PREFERRED EMBODIMENTS

Figure 1:
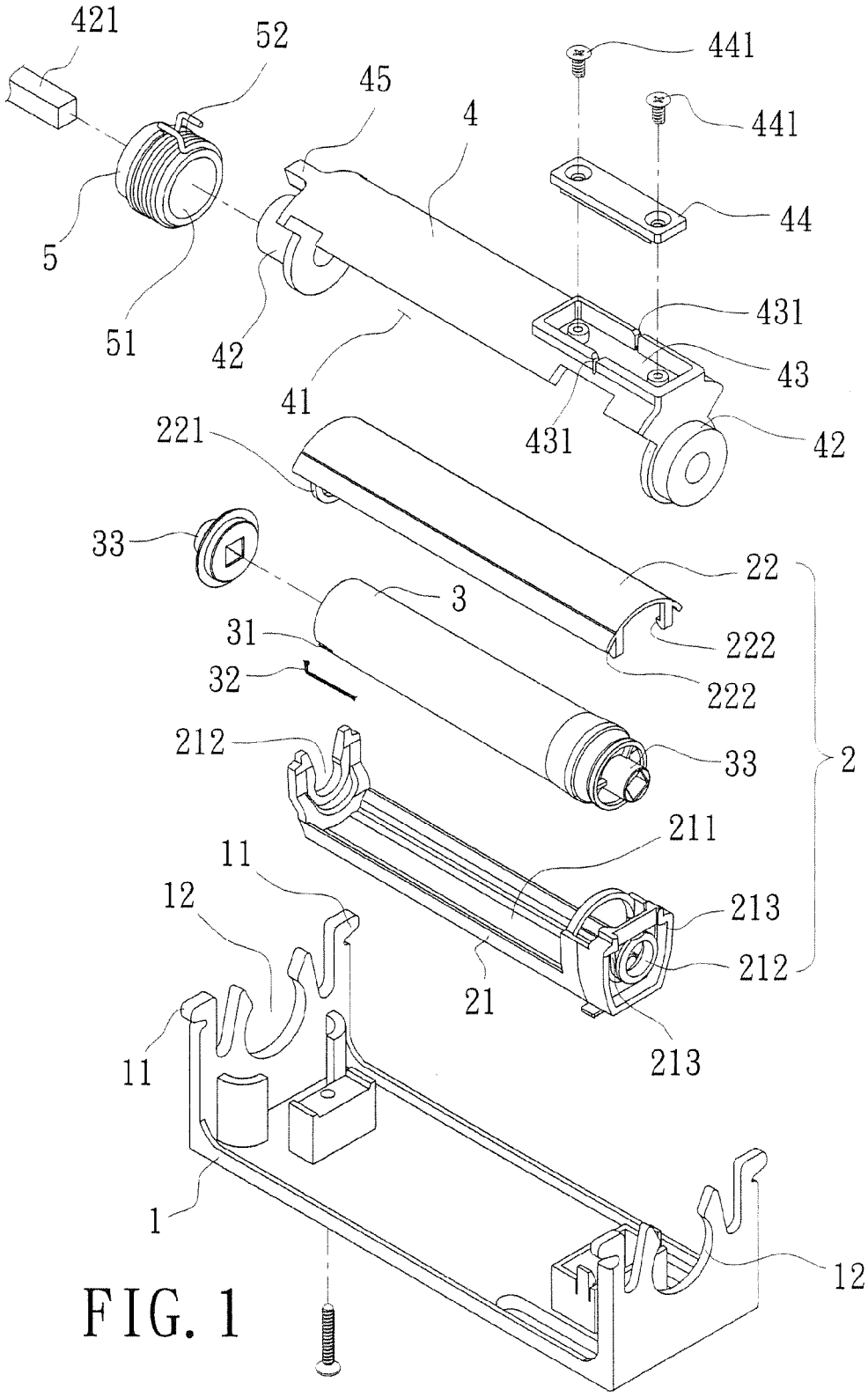
FIG. 1 is a perspective view showing the structure of the present invention.

FIG. 1 is a perspective exploded view of the present invention. Firstly referring to FIG. 1, the control device of the present invention comprises a base (1), a fitting member (2), a cord spool (3), a housing member (4), and a rotation member (5).

Figure 2:
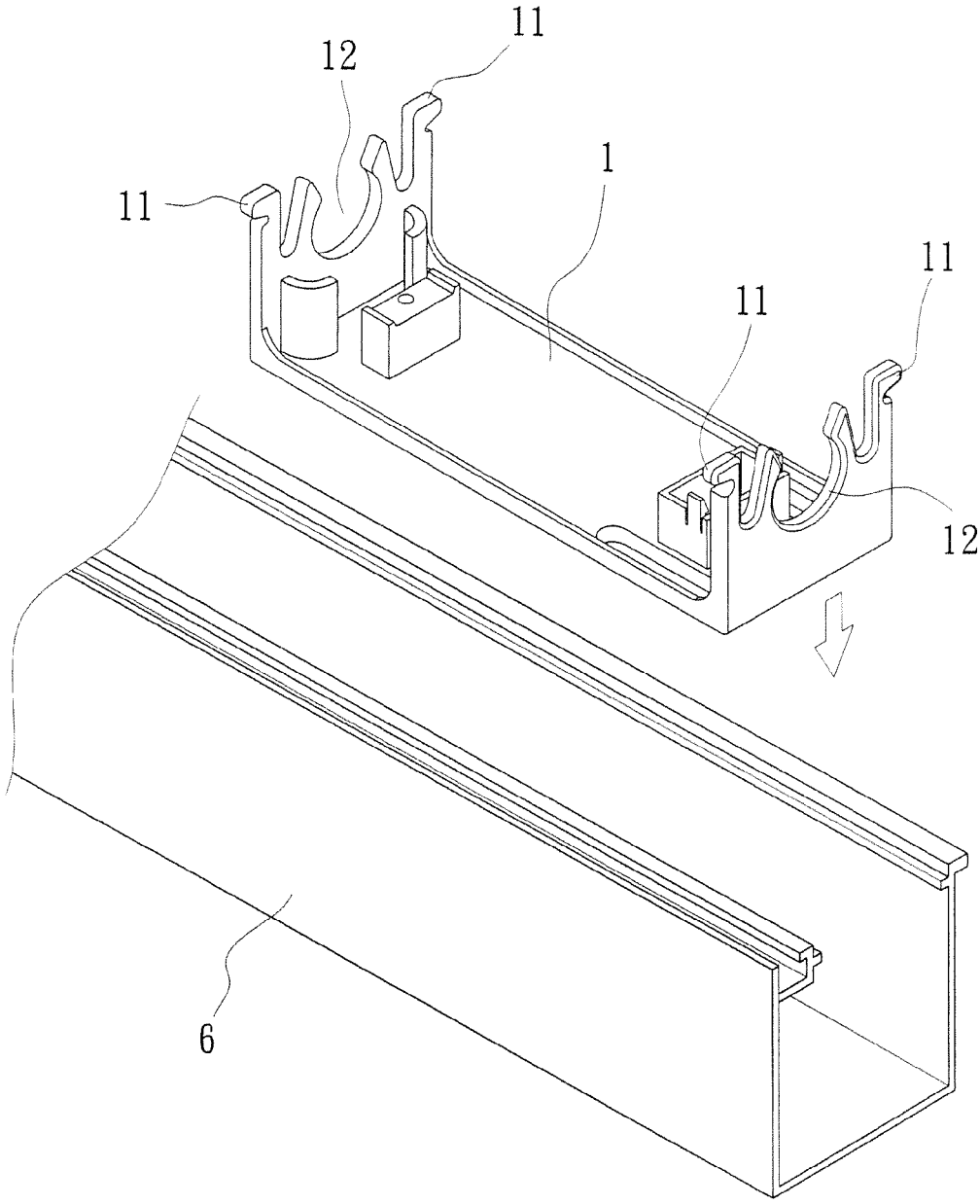
FIG. 2 is a schematic view showing the state of combination of the base of the present invention.

The base (1) has flexible snap fit portions (11) provided at the outer sides of both ends, and the base (1) can be fixed directly into the interior of the upper beam (6) of the window blind from the upper side thereof by the engagement of the flexible snap fit portions (11) (also referring to FIG. 2). Pivot holes (12) are provided at both ends of the base (1)

The fitting member (2) has a major body (21) with a cavity portion (211) provided in its middle part. Bearing portions (212) are provided at both ends of the major body (21). Further, two female snap-fit portions (213) are formed at the outer edges of one end of the major body (21). An upper cover (22) is provided at the upper end of the major body (21); a bearing portion (221) is formed at one end and two male snap-fit portions (222) corresponding to the female snap-fit portions (213) of the major body (21) are formed at the other end of the upper cover (22). Therefore, the upper cover (22) can be combined with the major body (21) by the engagement between the male snap-fit portions (222) and the female snap-fit portions (213).

The cord spool (3) can be received between the cavity portion (211) of the major body (21) and the upper cover (22) of the fitting member (2). A pull cord fixed part (31) is provided at the outer edge of the cord spool (3) for tying a pull cord (32). Axle portions (33) corresponding to the bearing portions (212), (221) of the major body (21) and of the upper cover (22) are respectively provided at both ends of the cord spool (3), so that the cord spool (3) can rotate in the fitting member (2) by the mutual fitting between the axle portions (33) and the bearing portions (212), (221) of the major body (21) and of the upper cover (22).

The housing member (4) is formed with a hollow portion (41) corresponding to the fitting member (2) so as to house the fitting member (2) therein. Two shaft portions (42) are respectively formed at both ends of the housing member (4), one of the shaft portions (42) is pivotally fitted in the pivot hole (12) of the base (1) and the interior of this shaft portion (42) can be penetrated through by a axle rod (421) which is also fitted into the inside of the axle portions (33) of the cord spool (3). A locating recess (43) is provided at the upper surface of the housing member (4), and two clipping grooves (431) are provided at both sides of the locating recess (43). A lid (44) is fastened by two screw elements (441) to cover the locating recess (43). A protruding portion (45) corresponding to the rotation member (5) is further provided on the housing member (4).

The rotation member (5) has an axial bore (51), corresponding to the shaft portion (42) at the other end of the housing member (4), provided at one end, so that the rotation member (5) can be fitted on the outside of the shaft portion (42) by the axial bore (51). The other end of the rotation member (5) is pivotally fitted in the pivot hole (12) of the base (1). A torsion spring (52) is fitted on the outside of the rotation member (5), and the torsion spring (52) is stopped by the protruding portion (45) of the housing member (4).

Figure 3:
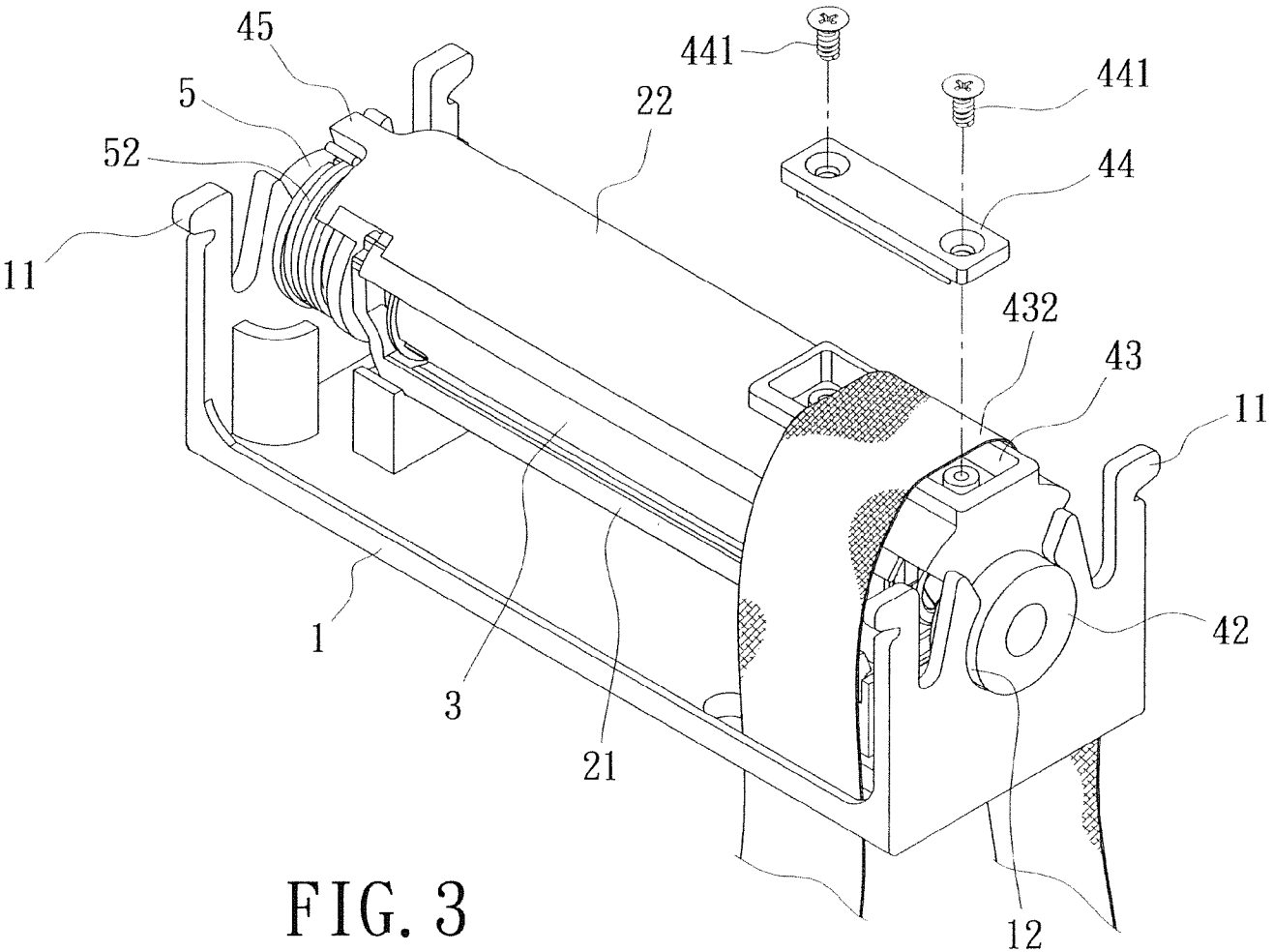
FIG. 3 is a partial perspective exploded view showing the structure of the present invention.
Figure 4:
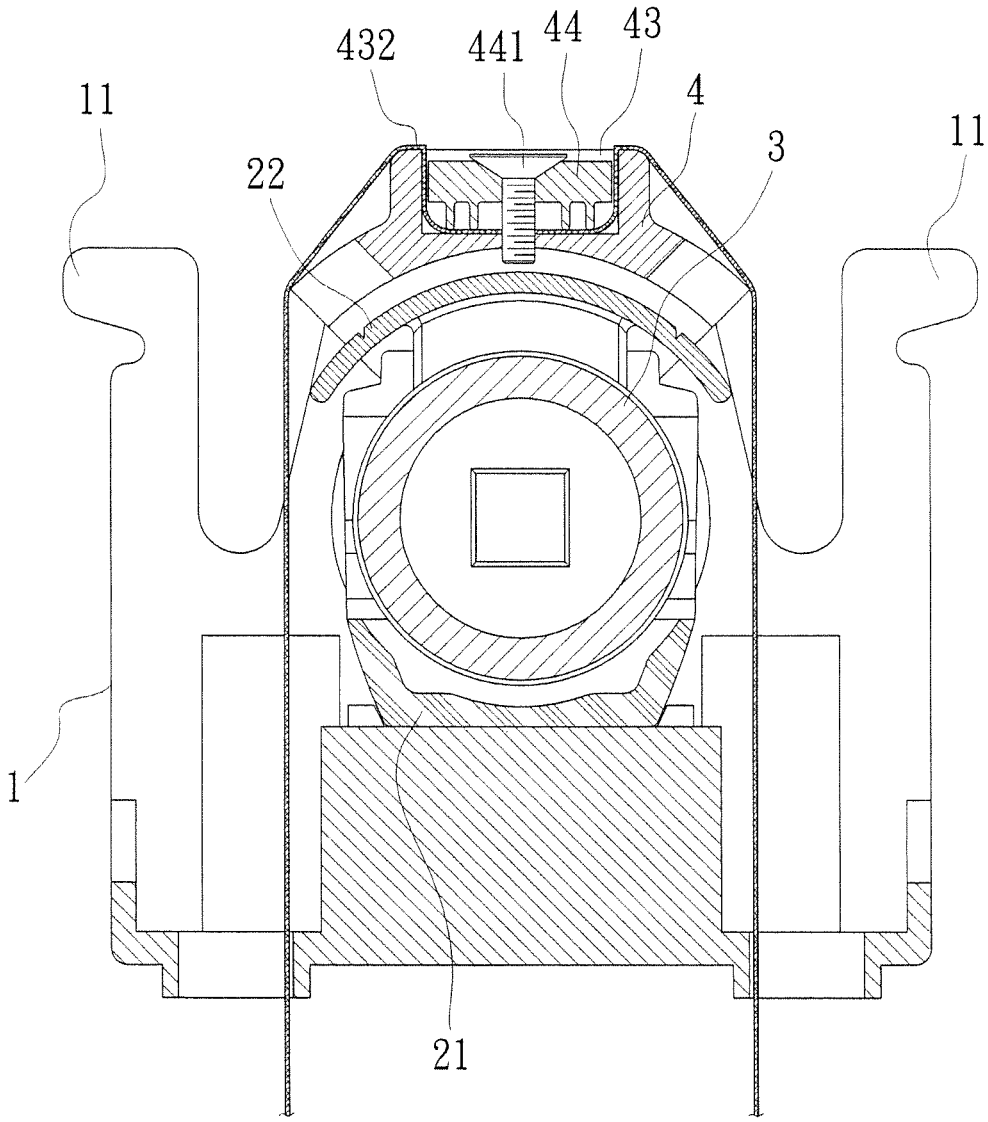
FIG. 4 is a sectional view showing the assembly of the present invention.
Figure 5:
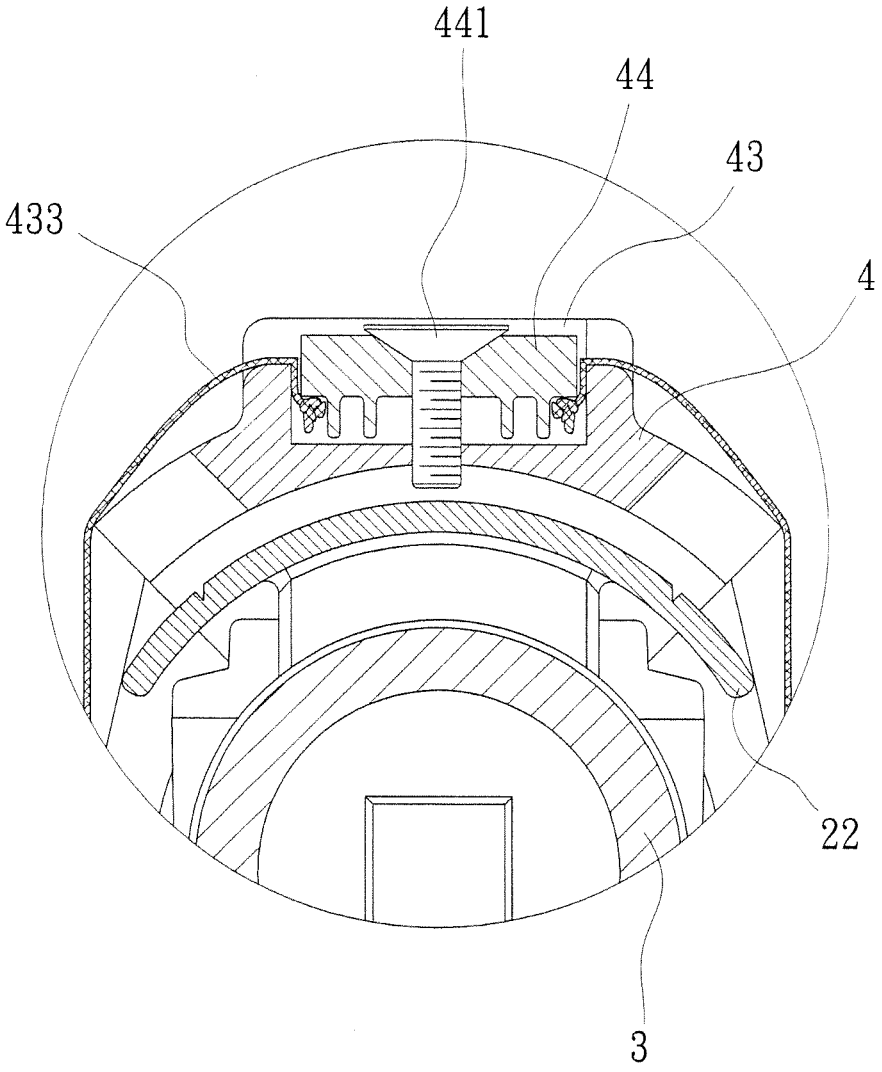
FIG. 5 is a sectional view showing the assembly of another embodiment of the present invention.

In this manner, referring to FIGS. 3 and 4, the cord spool (3) is accommodated between the cavity (211) of the major body (21) of the fitting member (2) and the upper cover (22), and one end of the pull cord (32) is tied to the pull cord fixing portion (31) provided at the outer edge of the cord spool (3). The other end of the pull cord (32) is wound around the outer edge of the cord spool (3). The fitting member (2) together with the cord spool (3) is housed within the hollow portion (41) of the housing member (4). The shaft portion (42) at one end of the housing member (4) is pivotally fitted in the pivot hole (12) of the base (1), and the shaft portion (42) at the other end is fitted in the axial bore (51) of the rotation member (5). After fitted with the torsion spring (52) over the outside, the other end of the rotation member (5) is pivotally fitted in the pivot hole (12) of the base (1) so that a connecting strap (432) for connecting each slat of the window blind is fixed in the locating recess (43) by the direct fastening of two screw elements (441) through the lid (44). Referring to FIG. 5, when a connecting string (433) is used to connect each slat of the window blind, the connecting string (433) can be placed in the clipping grooves (431) provided at both sides of the locating recess (43) and then the connecting string (433) is similarly fixed in the locating recess (43) by the direct fastening of two screw elements (441) through the lid (44).

Figure 6:
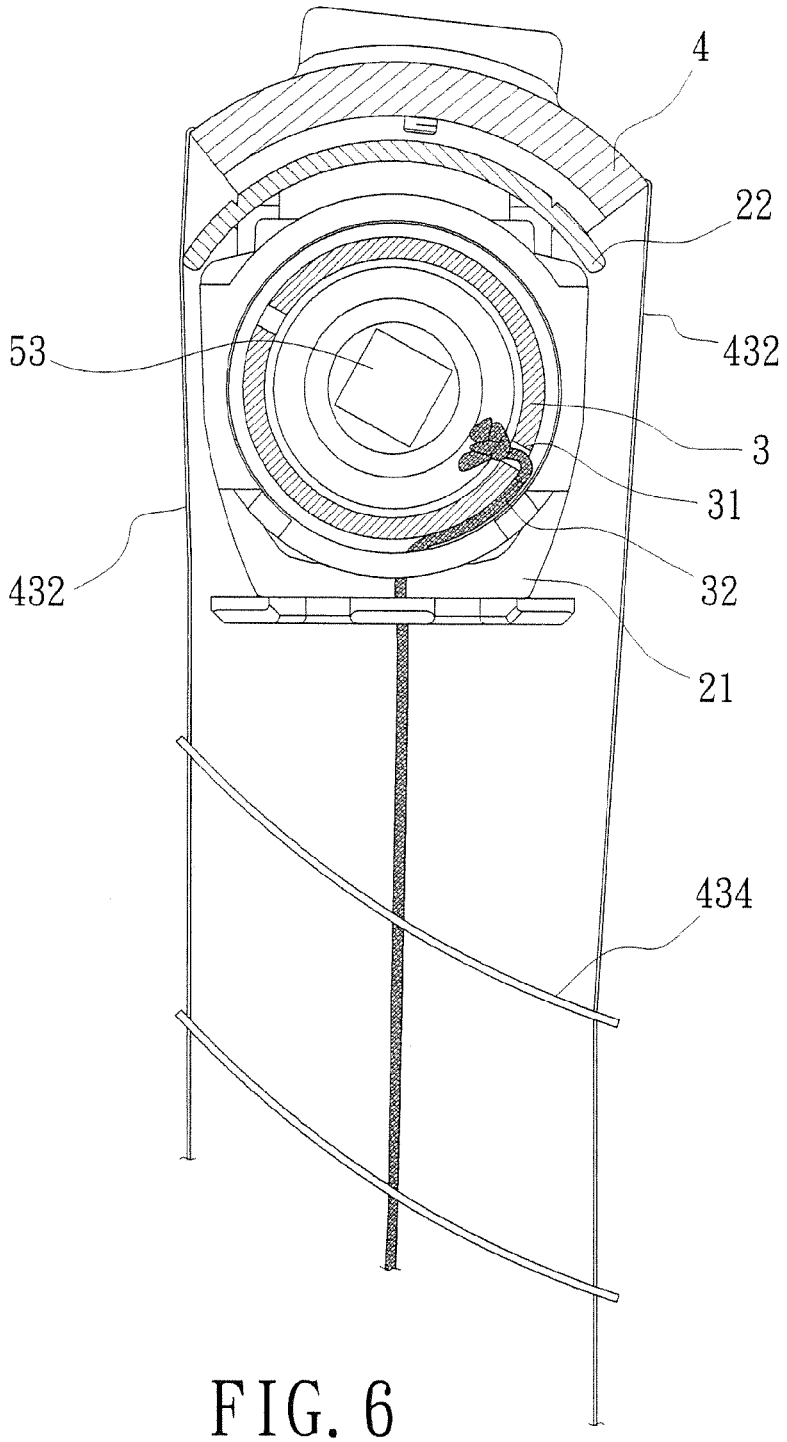
FIG. 6 is a schematic view I showing the using state of the present invention.
Figure 7:
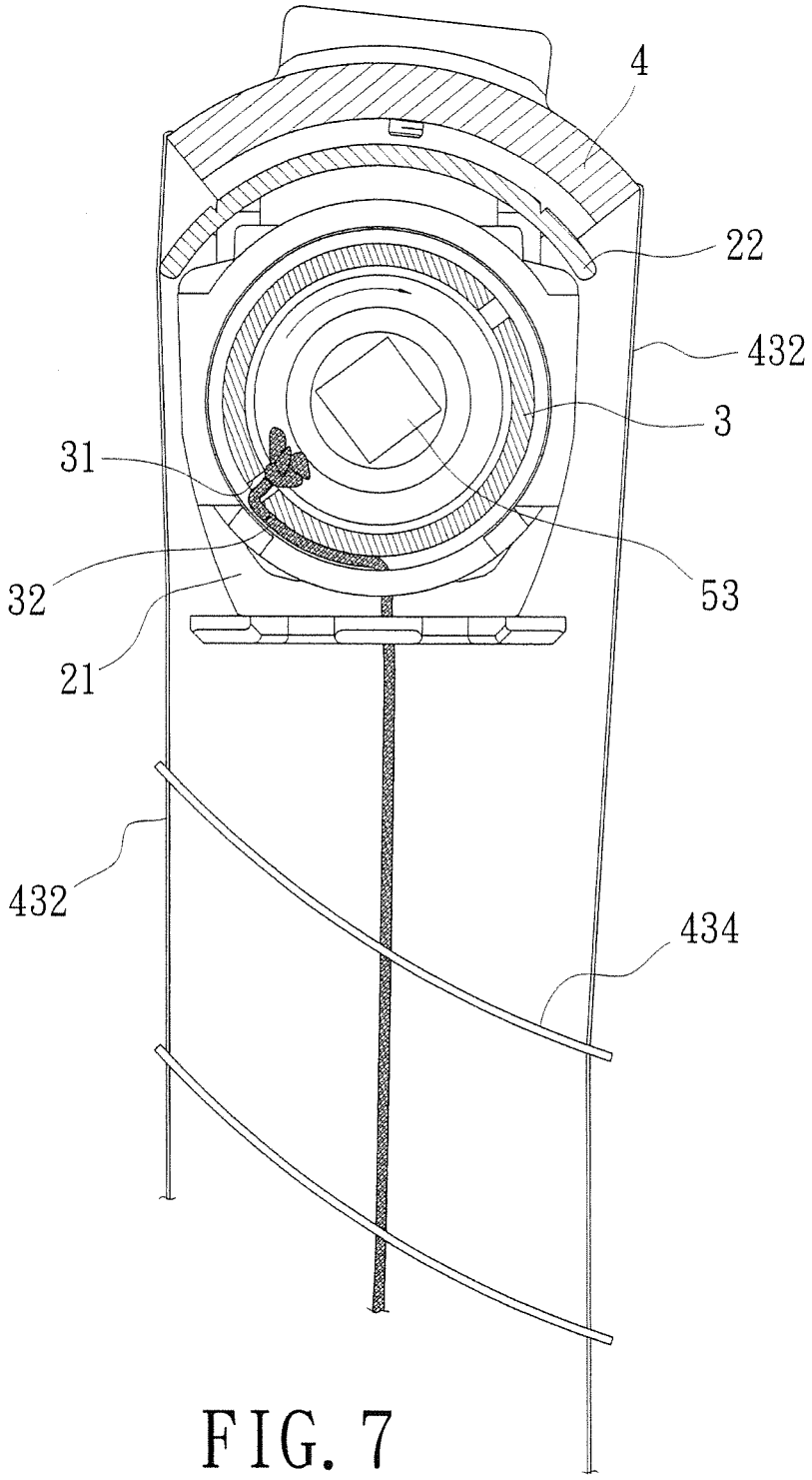
FIG. 7 is a schematic view II showing the using state of the present invention.
Figure 8:
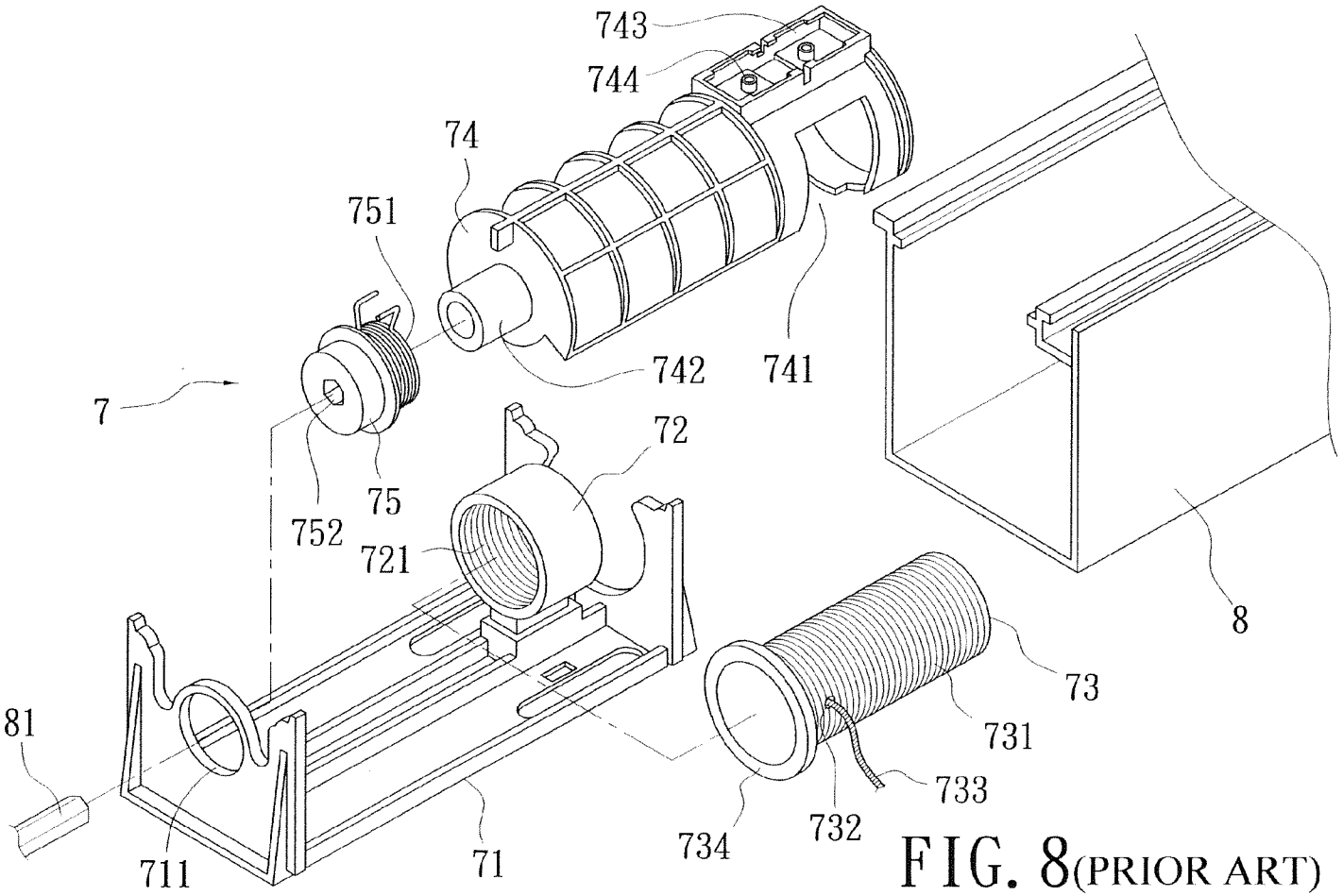
FIG. 8(PRIOR ART)
FIG. 8 is a perspective exploded view showing the structure of prior art.
Figure 9:
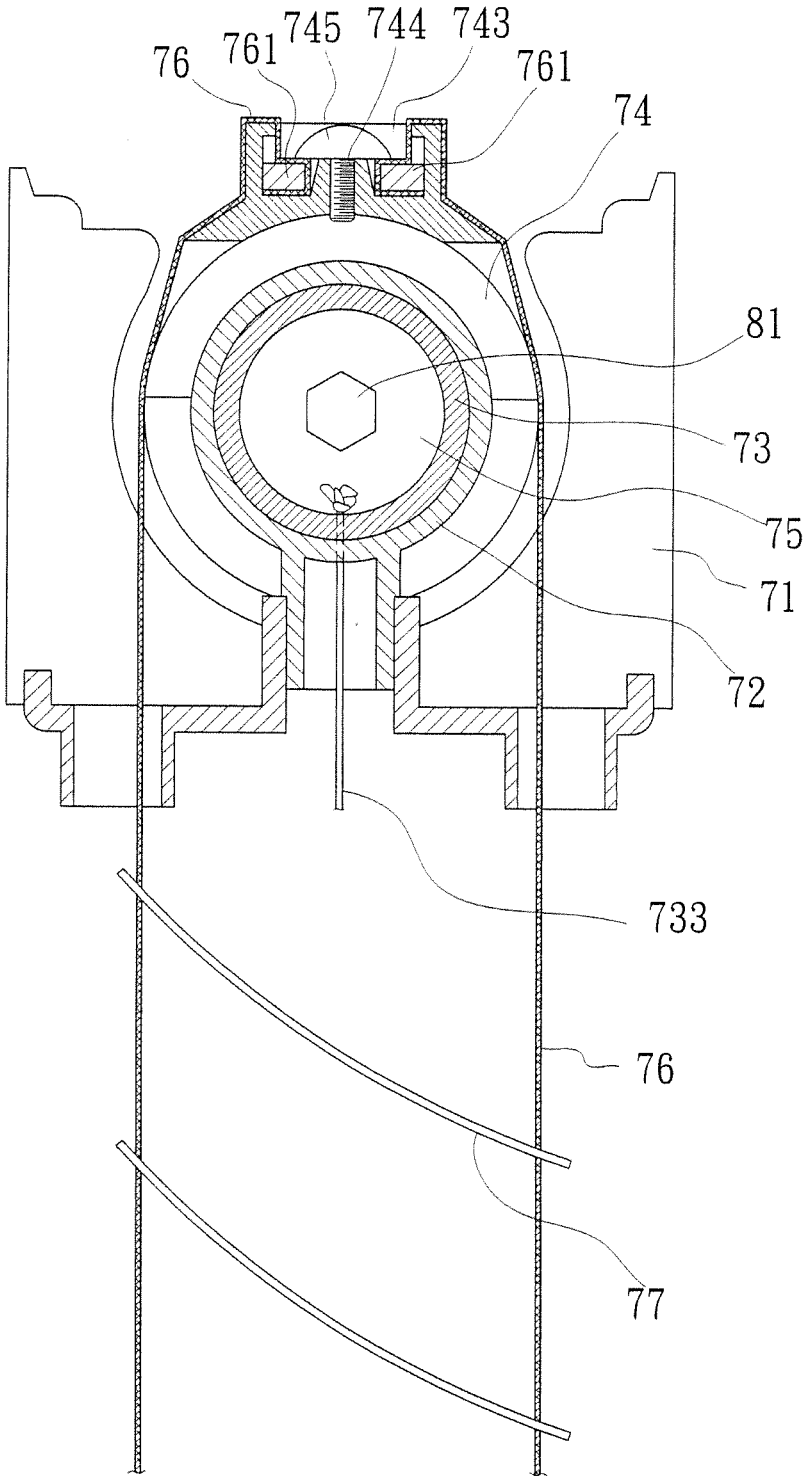
FIG. 9(PRIOR ART)
FIG. 9 is a sectional view showing the structure of the assembly of prior art.

Referring to FIG. 6, when the axle rod (421) penetrating through the shaft portion (42) of the housing member (4) and fitted in the axle portions (33) of the cord spool (3) is rotated, the rotation member (5) can be rotated and the leg of the torsion spring (52) moves the protruding portion (45) of the housing member (4) to turn an angle so that the connecting strap (432) fixed in the locating recess (43) rotates the slats (434) in unison the same angle. Then, the housing member (4) is limited by the torsion spring (52) so as not to continue further rotation, while the cord spool (3) continues its rotation by the action of the axle rod (421). Therefore, according to the winding or unwinding of the pull cord (32) wound around the cord spool (3), the lifting or lowering of each slat (434) of the window blind can be controlled. In the process of winding or unwinding of the pull cord (32) around the cord spool (3) actuated by continuous rotation of the axle rod (421), if the pull cord (32) is unwound from one side of the cord spool (3) all the way to the end, because the cord spool (3) is accommodated between the cavity portion (211) of the major body (21) of the fitting member (2) and the upper cover (22), the cord spool (3) can continue it rotation in the fitting member (2) so that the pull cord (32) can be wound upward from the other side of the cord spool (3) as shown in FIG. 7. Therefore, there is no limitation on the winding direction of the pull cord (32).

Based on the above description of the structural constitution and the implementation of the present invention, the present invention has the following advantages, when compared with prior art.

1. In the present invention, the base has flexible snap fit portions provided at both ends, so that the base can be fixed directly into the interior of the upper beam from the upper side thereof by the engagement of the flexible snap fit portions. Therefore, the mounting of the base into the upper beam is easy and convenient.

2. In the present invention, the cord spool is accommodated between the cavity portion of the fitting member and the upper cover, so that the cord spool can continue it rotation in the fitting member. Therefore, there is no limitation on the winding direction of the pull cord.

3. In the present invention, a connecting strap for connecting each slat of the window blind is fixed in the locating recess positioned on the upper face of the housing member by the direct fastening of two screw elements through the lid; or a connecting string for connecting each slat of the window blind is placed in the clipping grooves provided at both sides of the locating recess and then the connecting string is similarly fixed in the locating recess by the direct fastening of two screw elements through the lid. Therefore, either the connecting strap or the connecting string is easily to be fixed on the housing member.

What is claimed is:

1. A slat rotation, slat winding and unwinding control device of a window blind, comprising a base with two ends and two sides, a fitting member, a cord spool, a housing member, and a rotation member, wherein:

said base has flexible snap fit portions provided at both ends, said base being fixed directly into the interior of an upper beam of the window blind from an upper side thereof by the engagement of the flexible snap fit portions; a pivot hole is further provided at each end of said base;

said fitting member has a major body with a cavity portion provided in its middle part, said major body having two ends with each end having outer edges, bearing portions being provided at both ends of said major body, two female snap-fit portions being formed at the outer edges of one end of said major body, an upper cover being provided at an upper end of said major body; a bearing portion being formed at one end and two male snap-fit portions corresponding to said female snap-fit portions of said major body being formed at the other end of said upper cover, so that said upper cover is combined with said major body by the engagement between said male snap-fit portions and said female snap-fit portions;

said cord spool is received between said cavity portion of said major body and said upper cover of said fitting member, a pull cord fixed part being provided at the outer edge of said cord spool for tying a pull cord, axle portions corresponding to said bearing portions of said major body and of said upper cover being respectively provided at both ends of said cord spool so that said cord spool is rotatable in said fitting member by the mutual fitting between said axle portions and said bearing portions of said major body and of said upper cover;

said housing member is formed with a hollow portion corresponding to said fitting member so as to house said fitting member therein, two shaft portions being respectively formed at both ends of said housing member, one of said shaft portions being pivotally fitted in said pivot hole of said base and the interior of said one shaft portion being penetrated through by an axle rod which is also fitted into the inside of said axle portions of said cord spool, a locating recess being provided at the upper surface of said housing member, and two clipping grooves being provided at both sides of said locating recess, a lid being fastened by two screw elements to cover said locating recess, a protruding portion corresponding to said rotation member being further provided on said housing member;

said rotation member has an axial bore, corresponding to said shaft portion at the other end of said housing member, provided at one end so that said rotation member is fitted on the outside of said shaft portion by said axial bore, the other end of said rotation member being pivotally fitted in said pivot hole of said base, a torsion spring being fitted on the outside of said rotation member and said torsion spring being stopped by said protruding portion of said housing member.

2. The slat rotation, slat winding and unwinding control device of window blind as claimed in claim 1, wherein a connecting strap for connecting each slat of the window blind is fixed in said locating recess positioned on the upper face of said housing member by direct fastening of two screw elements through said lid.

3. The slat rotation, slat winding and unwinding control device of window blind as claimed in claim 1, wherein a connecting string for connecting each slat of the window blind is placed in said clipping grooves provided at both sides of said locating recess and then said connecting string is fixed in said locating recess by direct fastening of two screw elements through said lid.

* * * * *